United States Patent [19]

Kliem

[11] Patent Number: 4,740,448

[45] Date of Patent: Apr. 26, 1988

[54] HYBRID COLOR FILMS WITH DYE DEVELOPER AND THIAZOLIDINE DYE RELEASER

[75] Inventor: Peter O. Kliem, Weston, Mass.

[73] Assignee: Polaroid Corporation, Cambridge, Mass.

[21] Appl. No.: 846,586

[22] Filed: Mar. 31, 1986

[51] Int. Cl.[4] ..... G03C 5/54

[52] U.S. Cl. ..... 430/214; 430/218; 430/222; 430/224

[58] Field of Search ..... 430/222, 224, 218, 214

[56] References Cited

U.S. PATENT DOCUMENTS

| | | | |
|---|---|---|---|
| 3,345,163 | 10/1967 | Land et al. | 430/212 |
| 3,443,941 | 5/1969 | Rogers | 430/222 |
| 3,585,028 | 6/1971 | Stephens | 430/222 |
| 3,719,489 | 3/1973 | Cieciuch et al. | 430/222 |
| 4,060,417 | 11/1977 | Cieciuch et al. | 430/214 |
| 4,098,783 | 7/1978 | Cieciuch et al. | 430/222 |

*Primary Examiner*—Richard L. Schilling

*Attorney, Agent, or Firm*—Stanley H. Mervis

[57] ABSTRACT

Diffusion transfer color films and processes are disclosed which use dye developer chemistry to form at least one color record and which use image dye-releasing thiazolidine chemistry to form at least one of the other color records.

9 Claims, 1 Drawing Sheet

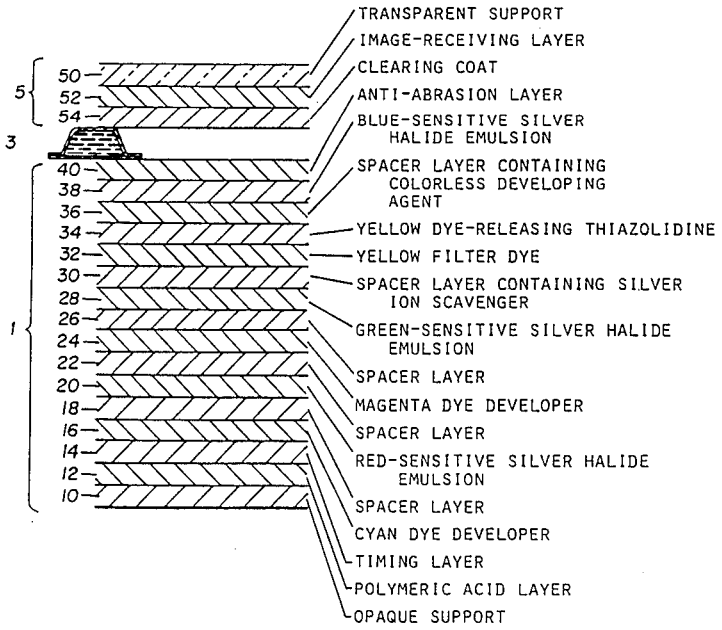

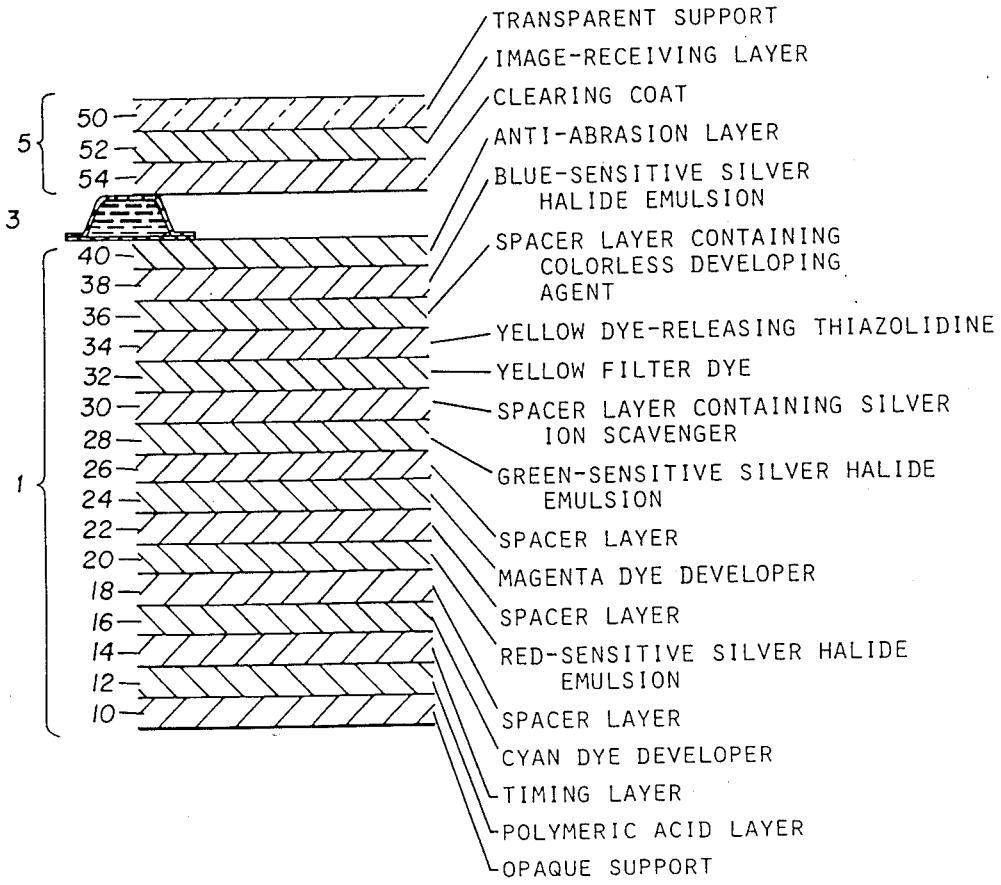
TRANSPARENT SUPPORT
IMAGE-RECEIVING LAYER
CLEARING COAT
ANTI-ABRASION LAYER
BLUE-SENSITIVE SILVER HALIDE EMULSION
SPACER LAYER CONTAINING COLORLESS DEVELOPING AGENT
YELLOW DYE-RELEASING THIAZOLIDINE
YELLOW FILTER DYE
SPACER LAYER CONTAINING SILVER ION SCAVENGER
GREEN-SENSITIVE SILVER HALIDE EMULSION
SPACER LAYER
MAGENTA DYE DEVELOPER
SPACER LAYER
RED-SENSITIVE SILVER HALIDE EMULSION
SPACER LAYER
CYAN DYE DEVELOPER
TIMING LAYER
POLYMERIC ACID LAYER
OPAQUE SUPPORT
5
50
52
54
3
1
40
38
36
34
32
30
28
26
24
22
20
18
16
14
12
10

HYBRID COLOR FILMS WITH DYE DEVELOPER AND THIAZOLIDINE DYE RELEASER

This invention relates to photography, and more particularly to novel films and processes for forming multicolor images by diffusion transfer. Such films are frequently referred to as "self-developing" or "instant" color films.

BACKGROUND OF THE INVENTION

Diffusion transfer multicolor films have been commercially available since 1963, when Polaroid Corporation introduced Polacolor film. This subtractive color film employed red-sensitive, green-sensitive, and blue-sensitive silver halide layers, having associated therewith, respectively, cyan, magenta and yellow dye developers in accordance with the process disclosed and claimed in U.S. Pat. No. 2,983,606 issued May 9, 1961 to Howard G. Rogers. Dye developers are compounds which contain both a silver halide developing moiety and the chromophoric system of a dye. Subsequent Polaroid diffusion transfer films, including SX-70, Time-Zero and 600 self-developing color films, also have used cyan, magenta and yellow dye developers. In these films, oxidation of the dye developer in exposed areas and consequent immobilization thereof has been the mechanism for obtaining imagewise distributions of unoxidized, diffusible cyan, magenta and yellow dye developers which are transferred by diffusion to the positive or image-receiving layer. While a dye developer itself may develop exposed silver halide, in practice the dye developer process has utilized a colorless developing agent, sometimes referred to as an "auxiliary developer", a "messenger developer" or an "electron transfer agent", which developing agent develops the exposed silver halide. The oxidized developing agent then participates in a redox reaction with the dye developer, thereby oxidizing and immobilizing the dye developer imagewise. A particularly useful messenger developer has been 4'-methylphenylhydroquinone (MPHQ).

Other self-developing color films also have been introduced commercially. Kodak PR-10 films utilized a redox reaction in developed areas to release a diffusible image dye from a p-sulfonamidophenol or a p-sulfonamidonaphthol precursor. Fuji FI-10 films employed a similar dye release redox mechanism using m-sulfonamidophenol precursors. Agfachrome Speed film utilized a dye release mechanism in which a quinone precursor was imagewise reduced in undeveloped areas to release a diffusible image dye.

Each of the above commercial color transfer films used a redox reaction to prevent or initiate transfer of the image dyes, and the same redox reaction was used for all three image dyes in a given film.

U.S. Pat. Nos. 3,719,489 issued March 6, 1973 and 4,098,783 issued July 4, 1978, both in the names of Ronald F. W. Cieciuch, Robert R. Luhowy, Frank A. Meneghini and Howard G. Rogers, disclose diffusion transfer processes wherein a diffusible image dye is released from an immobile precursor by silver-initiated cleavage of certain sulfur-nitrogen containing compounds, preferably a cyclic 1,3-sulfur nitrogen ring system, and most preferably a thiazolidine compound. For convenience, these compounds may be referred to as "image dye-releasing thiazolidines". The same release mechanism is used for all three image dyes, and, as will be readily apparent, the image dye-forming system is not redox controlled.

In general, proposals to form subtractive multicolor diffusion transfer images have contemplated use of the same type of reaction to provide the requisite imagewise distrubutions of diffusible cyan, magenta and yellow image dyes. An exception is found in U.S. Pat. No. 3,345,163 issued Oct. 3, 1967 to Edwin H. Land and Howard G. Rogers. While the preferred embodiment of said patent is the use of cyan, magenta and yellow dye developers as in Polacolor film, there is a proposal (col. 10, line 39 et seq.) to use a different reaction to control each image dye; more specifically, a proposed combination would use a tanning developer to control the cyan image dye, a coupling developer to control a magenta coupling image dye, the yellow image dye being a dye developer. In each instance, transfer of the image dye occurs where the respective developing agent was not oxidized and the image dye is diffusible unless its transfer is prevented.

Another proposal to use two different image dye control mechanisms in one film is found in U.S. Pat. No. 3,585,028 issued June 15, 1971 to Robert K. Stephens. This patent proposes to use a mobile (diffusible) dye developer and an immobile (non-diffusible) image dye precursor which releases a diffusible dye following oxidation and ring-closure. In Example 1, such a combination is used to obtain a neutral image by transfer of a cyan dye developer and a "reddish" dye developer released by ring-closure, using a single silver halide emulsion layer. In Example 2 of this patent, a yellow image is obtained by transfer of a yellow dye released by oxidation of such a ring-closing precursor in addition to a yellow dye developer, again using a single silver halide emulsion layer. In each instance, oxidation of the ring-closing image dye precursor is effected as the result of development of a silver complex transferred to a nuclei layer and subsequent cross-oxidation by the oxidized form of a non-diffusible developing agent.

In multicolor dye developer transfer processes, it has been recognized that, for example, less magenta density may be present in the transfer image where there has been blue exposure but no green exposure than one would have predicted, i.e., some magenta dye developer did not transfer even though there was no exposed green-sensitive silver halide to control its transfer. This problem is sometimes referred to as "magenta dropoff" and is believed to be the result of oxidation of the magenta dye developer as a result of the development of exposed blue-sensitive silver halide (rather than green-sensitive silver halide), the magenta dye developer being oxidized either directly or by an electron transfer redox reaction with oxidized messenger developer oxidized by exposed blue-sensitive silver halide. This undesired reaction is, at least in major part, because the magenta dye developer has to diffuse through the blue-sensitive silver halide layer to reach the image-receiving layer. In addition, the possibility has been recognized that yellow dye developer may be immobilized by development of green-sensitive silver halide, giving a different kind of crosstalk resulting in reduced yellow transfer density and increased magenta transfer density. Analogous situations may occur between the magenta and cyan dye developers. Such undesired interactions reduce color saturation and color separation and accuracy in the final image. This invention is concerned with reducing, if not eliminating, such undesired interactions.

SUMMARY OF THE INVENTION

In accordance with the present invention, a subtractive color transfer film is provided which utilizes two different imaging mechanisms: dye developers and image dye-releasing thiazolidines. The image dye positioned the greatest distance from the image-receiving layer is a dye developer, and the image dye positioned closest to the image-receiving layer is provided by an image dye-releasing thiazolidine. The other image dye-providing material may be either a dye developer or an image dye-releasing thiazolidine. This combination of image dye systems and sequence has been found to substantially reduce, or even eliminate, the very serious problems in color transfer films.

The dye developer process and the thiazolidine dye release process operate by different mechanisms, the former being a redox system and the latter being a silver-initiated cleavage of a thiazolidine to release a diffusible image dye. As a result, a film has been designed which substantially reduces the problem of crosstalk between adjacent silver halide emulsion layers in the formation of their respective imagewise distributions of diffusible image dyes.

In the preferred embodiment, the film employs a cyan dye developer, a magenta dye developer and a yellow image dye-releasing thiazolidine.

THE DRAWINGS

The FIGURE illustrates, in exaggerated diagrammatic cross-section, the arrangement of layers of a diffusion transfer film in accordance with a preferred embodiment of this invention.

DETAILED DESCRIPTION OF THE INVENTION

As noted above, subtractive multicolor diffusion transfer films comprise a blue-sensitive silver halide emulsion in association with a yellow image dye, a green-sensitive silver halide emulsion in association with a magenta image dye, and a red-sensitive silver halide emulsion in association with a cyan image dye. Each silver halide emulsion and its associated image dye may be considered to be a "sandwich", i.e., the red sandwich, the green sandwich and the blue sandwich. Similarly, the associated layers which cooperate (e.g., the red-sensitive silver halide emulsion and its associated cyan dye developer) to create each imagewise distribution of diffusible image dye may be referred to collectively as, e.g., the red image component of the photosensitive element. In a film unit of the type described in U.S. Pat. No. 3,415,644 issued Dec. 10, 1968 to Edwin H. Land, the red sandwich or image component is positioned closest to the support for the photosensitive element, and the blue image component is positioned the farthest from said support and closest to the image-receiving layer. In a film unit of the type described in U.S. Pat. No. 3,594,165 issued July 20, 1971 to Howard G. Rogers, the red image component is closest to the support for the photosensitive element, and it also is the closest to the image-receiving layer since said layer is carried by the same support. Accordingly, the blue image component is most distant from said support and from the image-receiving layer.

In the film unit described in said Land U.S. Pat. No. 3,415,644, the photosensitive element and the image-receiving element are held in superposed relationship before, during and after exposure and processing to form the multicolor transfer image. As this type of film unit has been commercialized (initially as SX-70 film), the support for the photosensitive element is opaque, the support for the image-receiving element is transparent, and a light-reflecting layer against which the image in the image-receiving layer may be viewed is formed by distributing a layer of processing composition containing a light-reflecting pigment (titanium dioxide) between the superposed elements. By also incorporating suitable pH-sensitive optical filter agents, preferably pH-sensitive phthalein dyes, in the processing composition as described in U.S. Pat. No. 3,647,347 issued Mar. 7, 1972 to Edwin H. Land, the film unit may be ejected from the camera immediately after the processing composition has been applied, with the process being completed in ambient light while the photographer watches the transfer image emerge.

In the presently preferred embodiments of this invention, the cyan and magenta image dyes are dye developers, and the yellow image dye is provided by an image dye-releasing thiazolidine. Such a combination has been found to produce multicolor dye transfer images which exhibit high yellow and magenta saturation and little, if any, magenta dropoff.

For convenience, further decription of this invention will refer to the FIGURE which illustrates in diagrammatic cross-section a film unit representing a preferred embodiment of this invention, and adapted for use as an integral film of the type decribed in the above-mentioned U.S. Pat. No. 3,415,644. As shown in the FIGURE, a photosensitive component or element 1 is shown in superposed relationship with a transparent image-receiving ("positive") component or element 5 through which photoexposure of the photosensitive element is to be effected. A rupturable container or pod 3 releasably holding a processing composition is positioned between the photosensitive and image-receiving element 1 and 5. The photosensitive element 1 comprises an opaque support 10 carrying, in sequence, a neutralizing layer 12 of a polymeric acid, a layer 14 adapted to time the availability of the polymeric acid by preventing diffusion of the processing composition thereto for a predetermined time, a cyan dye developer layer 16, a spacer layer 18, a red-sensitive silver halide emulsion layer 20, a spacer layer 22, a magenta dye developer layer 24, a spacer layer 26, a green-sensitive silver halide emulsion layer 28, a spacer layer 30 containing a silver ion scavenger, a yellow filter dye layer 32, a layer 34 of a yellow image dye-releasing thiazolidine, a spacer layer 36 containing a colorless silver halide developing agent, a blue-sensitive silver halide emulsion layer 38, and a top coat or anti-abrasion layer 40. The image-receiving element or component 5 comprises a transparent support 50 carrying, in sequence, an image-receiving layer 52 and a clearing coat 54. As noted above, photoexposure is effected through the transparent support 50 and the layers carried thereon also are transparent, the film unit being so positioned in the camera that light admitted through the camera exposure or lens system is incident upon the outer or exposure surface of the transparent support 40. After exposure the film unit is advanced between suitable pressure applying members or rollers (not shown), rupturing the pod 3 thereby releasing and distributing a layer of an opaque processing composition containing titanium dioxide and pH-sensitive optical filter agents or dyes as taught in the above-mentioned Land U.S. Pat. No. 3,647,347, thereby forming a laminate of the photosensitive element, and the image-receiving element 5 with their respective supports providing the outer layers of the laminate. The processing composition contains a film-forming, viscosity-providing polymer and has an initial pH at which the optical filter agents contained therein are colored; the optical filter agents are selected to exhibit the appropriate light absorption, i.e., optical density, over the wavelength range of ambient light actinic to the photosensitive element. As a result, ambient or environmental light within that wavelength range incident upon the surface of transparent support 50 and transmitted traversely through said transparent support and the transparent layers carried thereon in the direction of the exposed silver halide emulsions is absorbed, thereby avoiding further exposure of the photo-exposed and developing silver halide emulsions. Exposed blue-sensitive silver halide is developed by a colorless silver halide developing agent (which will be described in more detail later) initially present in spacer layer 36. Unexposed blue-sensitive silver halide is dissolved by a silver solvent initially present in the processing composition and transferred to the layer 34 containing a yellow image dye-releasing thiazolidine. Reaction with the complexed silver initiates a cleavage of the thiazolidine ring and release of a diffusible yellow image dye, as described, for example, in the above-noted Cieciuch, et al. U.S. Pat. Nos. 3,719,489 and 4,098,783.

Development of the exposed green-sensitive and red-sensitive silver halide, preferably by a messenger developer, e.g, MPHQ, results in the imagewise immobilization of the magenta and cyan dye developers, respectively. Unoxidized magenta and cyan dye developers in unexposed areas of the green- and red-sensitive silver halide emulsions remain diffusible and transfer to the image-receiving layer 52 through the developed blue-sensitive silver halide emulsion layer 38. Transfer of the imagewise released yellow image dye and the imagewise unoxidized magenta and cyan dye developers to the image-receiving layer is effective to provide the desired multicolor transfer image.

Permeation of the alkaline processing composition through the timing layer 14 to the neutralizing (polymeric acid) layer 12 is so controlled that the process pH is maintained at a high enough level to effect the requisite development and image transfer and to retain the optical filter agents in colored form within the processing composition layer and on the silver halide emulsion side of said layer, after which pH reduction effected as a result of alkali permeation into the polymeric acid layer 12 is effective to reduce the pH to a level which changes the optical filter agents to a colorless form.

Absorption of the water from the applied layer of the processing composition results in a solidified film composed of the film-forming polymer and the white pigment dispersed therein, thus providing a light-reflecting layer which also serves to laminate together the photosensitive component 1 and the image-receiving component 5 to provide the final integral image. The positive transfer image present in the image-receiving layer 54 is viewed through the transparent support 50 against the light-reflecting layer which provides an essentially white background for the dye image and also effectively masks from view the developed photosensitive element 1.

The use of an image dye-releasing thiazolidine permits the use of much lower coverages of blue-sensitive silver halide than are used with a yellow dye developer. In turn, this means that the diffusing magenta dye developer is much less likely to be oxidized by development of exposed blue-sensitive silver halide, thereby reducing the likelihood of magenta dropoff. By the use of appropriate spacer layers or interlayers to provide a controlled delay between development of the blue-sensitive silver halide emulsion and development of the green-sensitive silver halide emulsion, the chance of magenta dye developer being oxidized by exposed blue-sensitive silver halide is further reduced.

As noted above, the magenta and cyan dye developers may be immobilized by a cross-oxidation or redox reaction with oxidized messenger developer, e.g., MPHQ. (The messenger developer is substantially colorless in its reduced form.) The oxidation potential of the messenger developer should be sufficiently less negative than that of the dye developers that the dye developer will have a more negative oxidation potential than the oxidized messenger developer.

As used herein, the expression "oxidation potential" or "$E_{\frac{1}{2}}$" refers to the "polarographic half wave potential" of the developing agent as measured in 1 molar KOH (pH 14) at 25° C. using a rotating platinum electrode and a saturated calomel electrode ("S.C.E.") as a reference electrode, and expressed in millivolts (mv). The more negative the $E_{\frac{1}{2}}$ is, the more reducing the compound is.

A currently preferred messenger developer is 4'-methylphenylhydroquinone (MPHQ), which has an $E_{\frac{1}{2}}$ of −220 mv. This oxidation potential is much less negative than that of the currently preferred magenta dye developer:

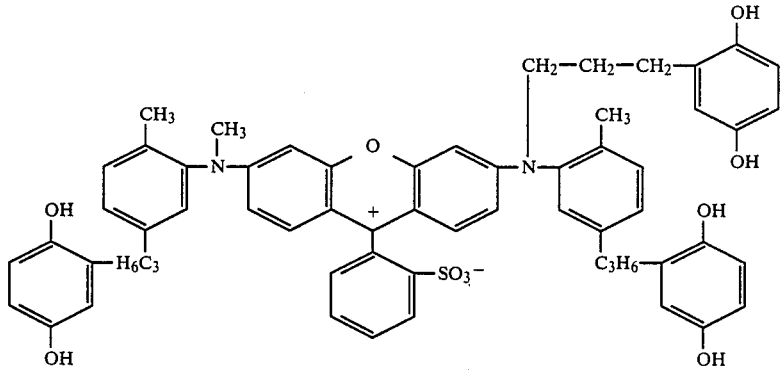

which has an $E_{\frac{1}{2}}$ of −300 mv, and also much less negative than that of the currently preferred cyan dye developer:

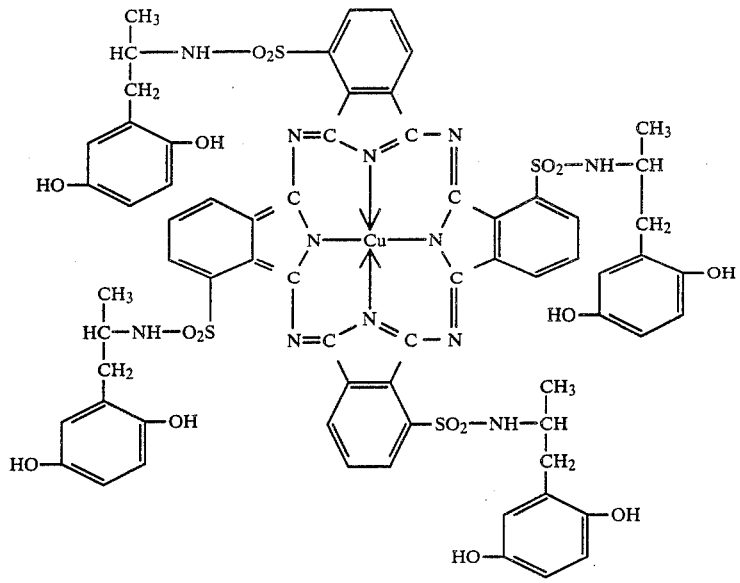

which has an $E_{\frac{1}{2}}$ of −275 mv. Accordingly, MPHQ can be seen to be an effective messenger developer.

The developing agent for the blue-sensitive silver halide emulsion also is substantially colorless, and may be referred to for convenience as the "colorless developing agent" or "primary developer". The oxidation potential of this developing agent must be sufficiently negative that its oxidation product will not cross-oxidize magenta or cyan dye developer. If such cross-oxidation were to occur, undesirable crosstalk could result if the oxidized colorless developing agent diffused into the green or red image component layers, or if it oxidized dye developer diffusing through the blue image component layers. Accordingly, it is desirable that the colorless developing agent used in film units containing the above illustrated magenta and cyan dye developers have an $E_{\frac{1}{2}}$ at least as negative as −300 mv. In the preferred embodiments, the colorless developing agent has an $E_{\frac{1}{2}}$ at least as negative as −360 mv. Examples of colorless developing agents found to be useful in the present invention, and their $E_{\frac{1}{2}}$, include:

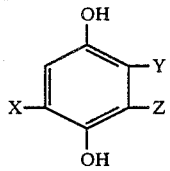

| X | Y | Z | $E_{1/2}$ |
|---|---|---|---|
| t-butyl | H | H | −315 mv |
| t-butyl | $-CH_3$ | H | −365 mv |
| t-butyl | $-C_6H_{13}$ | H | −475 mv |
| t-butyl | 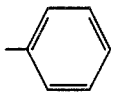 | H | −362 mv |

-continued

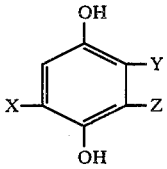

| X | Y | Z | $E_{1/2}$ |
|---|---|---|---|
| t-butyl | 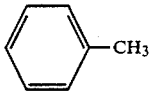 | H | −392 mv |

It will be understood that Y and Z may be taken together, e.g.,

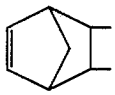

which, with X being t-butyl, i.e., 5,8-methano-5,8-dihydro-2-tertiarybutyl-1,4-dihydroxynaphthalene, has an $E_{\frac{1}{2}}$ of −317 mv. The quantity of colorless developing agent should not be significantly greater than the quantity which is the minimum sufficient to develop the blue-sensitive silver halide emulsion. The colorless developing agent may be positioned initially in the processing composition, or it may be included in one of the layers providing the blue image component. A preferred location, as illustrated in the FIGURE, is to incorporate the colorless developer in a spacer layer between the blue-sensitive silver halide layer and the layer containing the yellow dye-releasing thiazolidine.

It will be recognized that both MPHQ and tertiarybutylhydroquinone ("TBHQ") have been proposed, along with many other compounds, as colorless developing agents for use in processes employing image dye-releasing thiazolidines; see, for example, U.S. Pat. No. 4,481,277 issued Nov. 6, 1984 to William J. Pfingston. The photographic processes described therein use an image dye-releasing thiazolidine for each image dye, so the relative $E_{\frac{1}{2}}$ values are of no significance and the selection of the colorless developing agent is not so limited.

In the preferred embodiments of this invention, a silver ion scavenger is provided between each image component containing an image dye-releasing thiazolidine and the next adjacent image component, e.g., between the blue image component and the green image component in the FIGURE. The function of this scavenger is to capture any silver ions diffusing towards the yellow image dye-releasing thiazolidine from the green-sensitive silver halide as a result of silver solvent diffusing into the green-sensitive silver halide layer. Non-diffusible scavengers for silver ion have been disclosed in U.S. Pat. No. 4,060,417 issued Nov. 29, 1977 to Ronald F. W. Cieciuch, Robert R. Luhowy, Frank A. Meneghini and Howard G. Rogers. A preferred class of non-diffusible silver ion scavengers are colorless thiazolidines, e.g.,

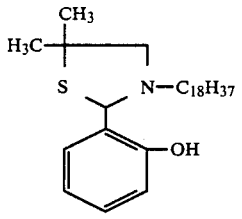

(A)

and

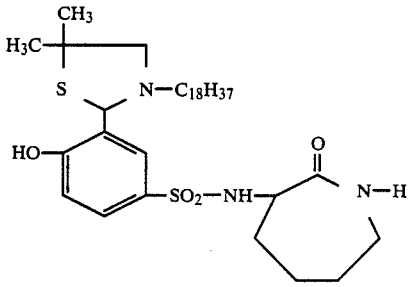

(B)

As is well understood in color photography, it is desirable to have a yellow filter between the blue-sensitive silver halide emulsion and the other silver halide emulsions so the latter are not exposed by blue light. In many instances, the yellow image dye-releasing thiazolidine will have sufficient density at the appropriate wavelengths to serve as the yellow filter. If this density is insufficient, a conventional non-diffusible yellow dye may be incorporated, either as a separate layer (note layer 32 in the FIGURE) or in the same layer as the yellow image dye-releasing thiazolidine.

The following examples are given to illustrate this invention and are not intended to be limiting. The magenta and cyan dye developers used in these examples are the magenta and cyan dye developers whose structure is shown above.

EXAMPLE 1

A photosensitive element A was prepared by coating, on a 4 mil (0.1 mm) opaque polyethylene terephthalate base, the following layers:

(1) A neutralizing layer of a partial butyl ester of polyethylene/maleic anhydride copolymer at a coverage of about 23,700 mg/m$^2$ and polyvinylbutyral at a coverage of about 2,600 mg/m$^2$.

(2) A timing layer of 60.6/29/6.3/3.7/0.4 pentapolymer of butylacrylate, diacetone acrylamide, styrene, methacrylic acid and acrylic acid at a coverage of about 3,448 mg/m$^2$ and about 52 mg/m$^2$ of gelatin.

(3) A layer of a gelatin dispersion of a cyan dye developer coated at a coverage of about 520 mg/m$^2$ of dye, and 225 mg/m$^2$ of gelatin.

(4) A spacer layer of titanium dioxide, poly(methylmethacrylate), gelatin, the above pentapolymer, and polyacrylamide coated at a coverage of about 1,000 mg/m$^2$ of titanium dioxide, 375 mg/m$^2$ of poly(methylmethacrylate), 125 mg/m$^2$ of gelatin, 375 mg/m$^2$ of said pentapolymer, and 100 mg/m$^2$ of polyacrylamide.

(5) A red sensitive gelatino-silver iodobromide (1% iodide; 1.5 micron) emulsion layer coated at a coverage of about 1,209 mg/m$^2$ of silver and 725 mg/m$^2$ of gelatin.

(6) An interlayer of the above pentapolymer coated at a coverage of about 3,420 mg/m$^2$, about 180 mg/m$^2$ of polyacrylamide and about 130 mg/m$^2$ of daintoin hardening agent.

(7) A layer of gelatin dispersion of a magenta dye developer and 6-dodecylaminopurine coated at a coverage of about 420 mg/m$^2$ of dye 210 mg/m$^2$ of gelatin and 96 mg/m$^2$ of 6-dodecylaminopurine.

(8) A green-sensitive gelatino-silver iodobromide (1% iodide) emulsion layer comprising a blend of 1.1 micron grains coated at a coverage of about 479 mg/m$^2$ of silver, 1.8 micron grains coated at a coverage of about 1,117 mg/m$^2$ of silver, and 750 mg/m$^2$ of gelatin.

(9) An interlayer of the above pentapolymer coated at a coverage of about 2,138 mg/m$^2$, about 112 mg/m$^2$ of polyacrylamide, and about 9 mg/m$^2$ of succindialdehyde.

(10) A layer of gelatin coated at a coverage of about 200 mg/m$^2$.

(11) A yellow filter and yellow dye layer comprising comprising 100 mg/m$^2$ of the yellow image dye-releasing thiazolidine having the formula

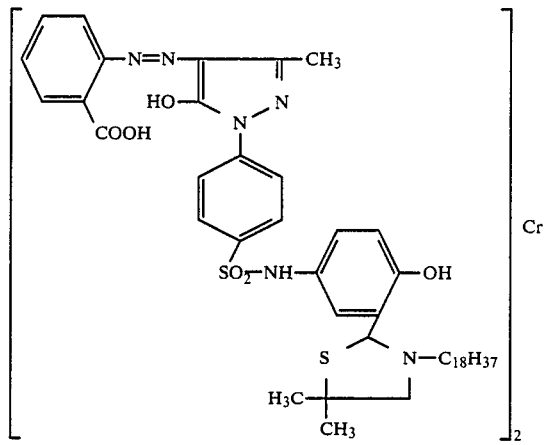

538 mg/m$^2$ of gelatin and 807 mg/m$^2$ of a non-diffusible benzidine yellow dye (as a filter dye).

(12) A blue-sensitive gelatino-silver iodobromide (6% iodide, 1.5 micron) emulsion layer coated at a coverage of about 195 mg/m$^2$ of silver, about 645 mg/m$^2$ of gelatin and about 430 mg/m$^2$ of tertiary butyl hydroquinone dissolved in diethyldodecanamide.

(13) An anti-abrasion top coat comprising about 325 mg/m$^2$ of gelatin.

A second photosensitive element B was coated having the same structure as element A, except that the blue-sensitive silver halide emulsion in photosensitive element B comprised about 195 mg/m$^2$ of silver, about 71 mg/m$^2$ of gelatin, and about 430 mg/m$^2$ of MPHQ dissolved in diethyldodecamide. A third photosensitive element C was coated like element B except that the coverage of MPHQ was about 645 mg/m$^2$.

The thus-prepared photosensitive elements A, B and C were exposed (2 meter-candle-seconds) and then processed by spreading a layer of alkaline processing composition between the photosensitive element and a superposed image-receiving element while the superposed elements were passed between a pair of pressure rollers spaced apart approximately 0.0032 inch. The image-receiving element was prepared by coating a transparent subcoated polyethylene terephthalate 4 mil (0.1 mm) support with an image-receiving layer coated at a coverage of about 300 mg/ft$^2$ (about 3,330 mg/m$^2$) of a graft copolymer comprising 4-vinyl pyridine (4VP) and vinyl benzyl trimethyl ammonium chloride (TMQ) grafted onto hydroxyethyl cellulose (HEC) at a ratio HEC/4VP/TMQ of 2.2/2.2/1, and about 4 mg/ft$^2$ of 1,4-butanediol diglycidyl ether cross-linking agent.

The processing composition comprised:

| | |
|---|---|
| Water | 8,254 g. |
| Potassium hydroxide (45%) | 3,150 g. |
| Poly-diacetone acrylamide oxime | 243 g. |
| Titanium dioxide | 13,872 g. |
| Benzotriazole | 132 g. |
| 4-amino-6-hydroxy-pyrazolo-(3,4d)-pyrimidine | 29 g. |
| N—2-2hydroxyethyl-N,N',N'—tris-carboxymethyl-ethylene diamine | 180 g. |
| Opacifying Dye 1: | 460 g. |

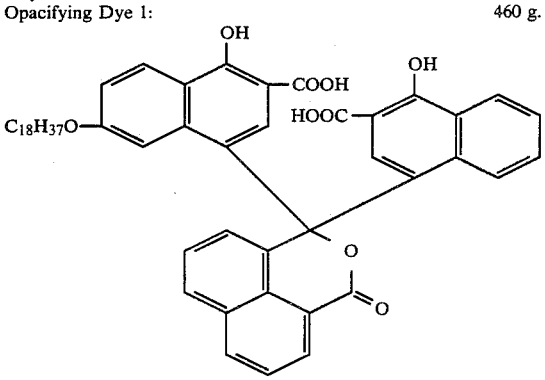

| | |
|---|---|
| Opacifying Dye 2: | 126 g. |

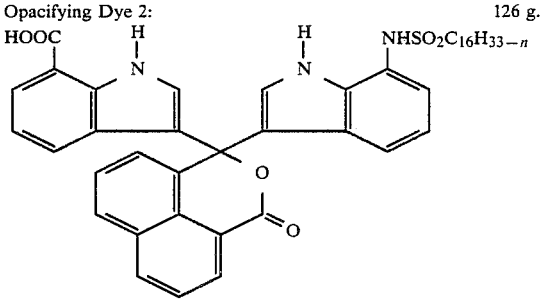

| | |
|---|---|
| Collodial silica (30% dispersion) | 222 g. |
| N—phenethyl-α-picolinium bromide (50% solution) | 792 g. |
| 2-methyl imidazole | 200 g. |
| 1-(4'-hydroxyphenyl)-5-mercaptotetrazole | 11.4 g. |
| N—phenethyl-pyridinium bromide | 60 g. |

-continued

| | |
|---|---|
| 6-methyl-5-bromo-4-azobenzimidazole | 29 g. |
| Nickel acetate | 120 g. |
| Citric acid | 88 g. |

The red, green and blue reflection densities for the multicolor transfer images processed as described using the above photosensitive elements A, B and C were:

| Film | Red | Green | Blue |
|---|---|---|---|
| | | $D_{max}$ | |
| A (TBHQ) | 2.20 | 2.08 | 1.95 |
| B (40 MPHQ) | 2.06 | 1.73 | 2.02 |
| C (60 MPHQ) | 2.07 | 1.76 | 2.05 |
| | | $D_{min}$ | |
| A (TBHQ) | 0.21 | 0.24 | 0.23 |
| B (40 MPHQ) | 0.25 | 0.25 | 0.35 |
| C (60 MPHQ) | 0.22 | 0.24 | 0.37 |

The film unit using TBHQ exhibit significantly higher red and green maximum density, more saturated magentas (less dropoff), more neutral blacks, reduced interimage effects generally, and sigificantly lower blue minimum density.

EXAMPLE 2

A photographic film unit adapted to the provision of a permanent photographic laminate was prepared in the following manner. A multicolor photosensitive element was prepared by coating the following layers, in succession, onto a subcoated opaque polyethylene terephthalate film base approximately 5 mil (0.127 mm) thick:

1. A polymeric acid layer comprising about 24,400 mg/m$^2$ of the half butyl ester of polyethylene/maleic anhydride copolymer, about 4310 mg/m$^2$ of polyvinyl butyral and about 89 mg/m$^2$ of titanium dioxide.

2. A layer of polystyrene/maleic anhydride copolymer coated at a coverage of about 400 mg/m$^2$.

3. A timing layer comprising a 40/40/18/2 tetrapolymer of butyl acrylate/diacetone acrylamide/carbomethoxymethyl acrylate/acrylic acid coated at a coverage of about 2207 mg/m$^2$.

4. A cyan dye developer layer comprising about 511 mg/m$^2$ of cyan dye developer, about 414 mg/m$^2$ of gelatin, about 60 mg/m$^2$ of 4'-methylphenyl hydroquinone (MPHQ), and about 108 mg/m$^2$ of 1,3-bis[1-(4-hydroxyphenyl)-tetrazolyl-(5)-mercapto]-2-propanone oxime.

5. A layer comprising about 800 mg/m$^2$ of titanium dioxide, about 375 mg/m$^2$ of 61/29/6/4/0.4 pentapolymer of butylacrylate/diacetone acrylamide/methylacrylic acid/styrene/acrylic acid, about 125 mg/m$^2$ of gelatin and about 37.5 mg/m$^2$ of polymethylmethacrylate.

6. A red-sensitive silver iodobromide (1.3% iodide; 1.5 micron) layer comprising about 300 mg/m$^2$ of silver and about 816 mg/m$^2$ of gelatin.

7. An interlayer comprising about 3554 mg/m$^2$ of the pentapolymer described in layer 3 and about 187 mg/m$^2$ of polyacrylamide;

8. A magenta dye developer layer comprising about 420 mg/m$^2$ of magenta dye developer, about 262 mg/m$^2$ of gelatin, about 500 mg/m$^2$ of 2-phenylbenzimidazole and 50 mg/m$^2$ of 2,3-bis[1-(4-hydroxyphenyl)-tetrazolyl-(5)-mercapto]-2-propanone oxime;

9. A layer comprising about 404 mg/m$^2$ of Dow 620 carboxylated styrene-butadiene copolymer latex and about 235 mg/m$^2$ of gelatin;

10. A green-sensitive silver iodobromide emulsion layer comprising about 1176 mg/m$^2$ of silver (1.8 micron, 1% iodide), about 295 mg/m$^2$ of silver (1.1 micron, 5/8% iodide), about 566 mg/m$^2$ of gelatin and about 260 mg/m$^2$ of MPHQ;

11. A layer comprising about 1967 mg/m$^2$ of the pentapolymer described in layer 3, about 103 mg/m$^2$ of polyacrylamide and about 565 mg/m$^2$ of the non-diffusible colorless thiazolidine silver ion scavenger

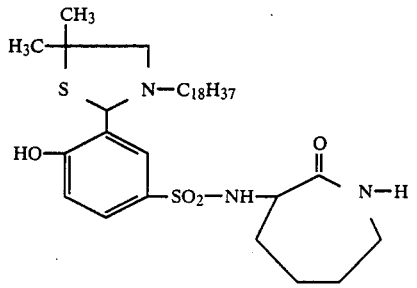

and 17 mg/m$^2$ of succindialdehyde;

12. A layer comprising about 475 mg/m$^2$ of benzidine yellow filter dye and about 143 mg/m$^2$ of 13. A yellow image dye-providing layer comprising about 1028 mg/m$^2$ of the yellow image dye-releasing thiazolidine:

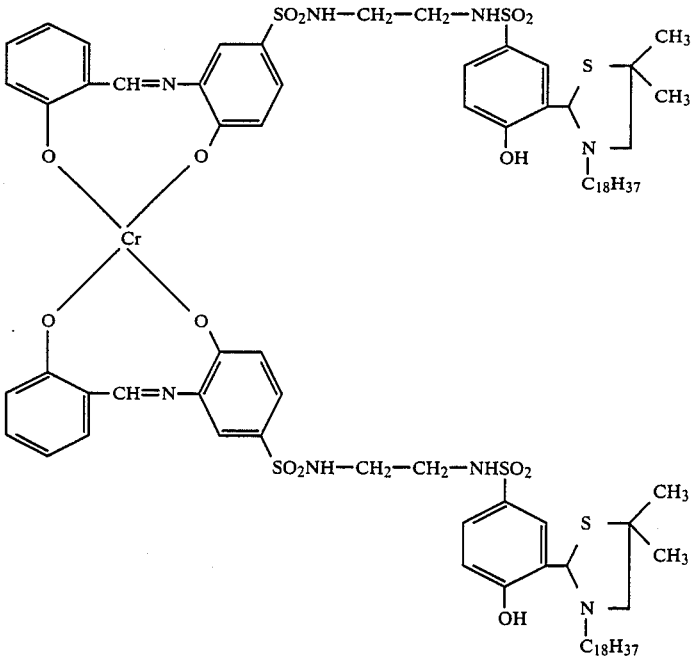

and about 411 mg/m$^2$ of gelatin;

14. A layer comprising about 490 mg/m$^2$ of 2-phenyl-5-tertiarybutyl-hydroquinone and about 270 mg/$^2$ of gelatin;

15. A blue-sensitive silver iodobromide (6% iodide) layer comprising about 232 mg/m$^2$ of silver (1.6 micron), about 58 mg/m$^2$ of silver (1.3 micron) and about 145 mg/m$^2$ of gelatin; and 16. An antiabrasion layer comprising about 800 mg/m$^2$ of gelatin.

The image-receiving element comprised an approximately 2.7 mil (0.069 mm.) polyester film base, including a small amount of an anti-light piping dye, upon which there were coated in succession:

1. An image-receiving layer coated at a coverage of about 3229 mg/m$^2$ of a graft copolymer comprised of 4-vinylpyridine (4VP) and vinyl benzyl trimethylammonium chloride (TMQ) grafted onto hydroxyethyl cellulose (HEC) at ratios of HEC/4VP/TMQ of 2.2/2.2/1 and about 54 mg/m$^2$ of 1,4-butanediol-diglycidyl ether; and 2. A clearing layer coated at a coverage of about 915 mg/m$^2$ comprising 1 part Igepal CO-997 (nonylphenoxyethylene oxide ethanol), 1 part of a 1.0/1.0/0.1/0.1 tetrapolymer of methacrylic acid-diacetone acrylamide/butyl acrylate/styrene and 0.3 part of polyvinylpyrrolidone.

The photosensitive element was placed in a superposed relationship with the image receiving element with their respective supports outermost and a rupturable container retaining an aqueous alkaline processing composition was fixedly mounted at the leading edge of the superposed elements, by pressure-sensitive tapes to make a film unit, so that, upon application of compressive force to the container to rupture the marginal seal of the container, the contents thereof would be distributed between the superposed elements.

The aqueous alkaline processing composition comprised (parts by weight):

| | |
|---|---|
| Water | 39.7 |
| Titanium dioxide | 48.0 |
| Poly(diacetone acrylamide)oxime | 0.66 |
| Potassium hydroxide (50% aqueous solution) | 4.30 |
| Colloidal silica (30% aqueous solution) | 0.23 |
| Zonyl FSN (40% solids) | 0.19 |
| N—phenethyl-α-picolinium bromide (50% solids) | 1.44 |
| 6-methyluracil | 0.41 |

-continued

| | |
|---|---|
| 2 methylimidazole | 0.49 |
| Hypoxanthine | 0.46 |
| 1-(4-hydroxyphenyl)-1H—tetrazole-5-thiol | 0.01 |
| Opacifying Dye 1 | 0.44 |
| Opacifying Dye 2 | 1.51 |
| Dow 620 carboxylated 67/33 styrene/ butadiene latex (50% solids) | 2.16 |

The film unit was photoexposed through the image-receiving element using an exposure of two meter-candle-seconds through a step wedge target. The processing composition was distributed at room temperature between the elements of the film unit by passing the film unit between a pair of pressure-applying rolls having a gap of approximately 0.0028 inch (0.071 mm.). The resulting laminate was maintained intact to provide a multicolor integral negative-positive reflection print which exhibited good color saturation and color balance with no magenta dropoff. The neutral density columns of the positive transfer image exhibited the following red, green and blue reflection densities:

| | Red | Green | Blue |
|---|---|---|---|
| $D_{max}$ | 1.63 | 1.97 | 1.76 |
| $D_{min}$ | 0.08 | 0.09 | 0.11 |

The use of carboxylated styrene/butadiene copolymer latex in the processing composition is the subject of the copending application of Richard J. Murphy, Ser. No. 846,587 filed concurrently herewith (now U.S. Pat. No. 4,680,247 issued July 14, 1987).

The 1,3-bis-[1-(4-hydroxyphenyl)-tetrazoyl-(5)-mercapto-2-propanone oxime in the cyan and magenta dye developer layers of the film unit in Example 2 releases 1-(4-hydroxyphenyl)-5-mercapto-tetrazole following contact with alkali, thereby providing an antifoggant after a predetermined period in the process. The use of such release compounds is particularly effective in controlling fog development at elevated temperatures. Furthermore, the rate of release of such restrainers is slower at lower temperatures thereby giving lower antifoggant concentrations and showing less restraint of development at lower temperatures and greater restraint at higher temperatures. These oxime development restrainer release compounds are the subject of the copending application of Roger A. Boggs, John B. Mahoney, Avinash C. Mehta, William C. Schwarzel and Lloyd D. Taylor, Ser. No. 846,584 filed concurrently herewith. Other development restrainer release compounds suitable for use in the film units of this invention are known in the art; see, for example, U.S. Pat. No. 4,562,138 issued Dec. 31, 1985 to Morito Uremura, et al.

Zonyl FSN nonionic surfactant used in the processing composition has the formula $$CF_3(CF_2)_m(CH_2)_2—O(CH_2CH_2O)_nH$$

The poly(methylmethacrylate) latex used in the spacer layers in the examples herein was prepared in the manner described in U.S. Pat. No. 4,347,301 issued Aug. 31, 1982 to Peter O. Kliem.

EXAMPLE 3

A photosensitive element D was prepared by coating the following layers, in succession, onto a subcoated opaque polyethylene terephthalate film base approximately 5 mil (0.127 mm) thick:

1. A polymeric acid layer comprising about 25,820 mg/m² of a 85:15 mixture by weight of the half butyl ester of polyethylene/maleic anhydride copolymer and polyvinyl butyral, and about 65 mg/m² of titanium dioxide.

2. A layer of polystyrene/maleic anhydride copolymer coated at a coverage of about 400 mg/m²

3. A timing layer comprising a 40/40/18/2 tetrapolymer of butyl acrylate/diacetone acrylamide/carbomethoxymethyl acrylate/acrylic acid coated at a coverage of about 2408 mg/m².

4. A cyan dye developer layer comprising about 551 mg/m² of cyan dye developer, about 330 mg/m² of gelatin, about 108 mg/m² of 4'-methylphenyl hydroquinone (MPHQ), and about 54 mg/m² of 1,3-bis[1-(4-hydroxyphenyl)-tetrazolyl-(5)-mercapto]-2-propanone oxime.

5. A layer comprising about 800 mg/m² of titanium dioxide, about 300 mg/m² of 61/29/6/4/0.4 pentapolymer of butylacrylate/diacetone acrylamide/methylacrylic acid/styrene/acrylic acid, about 100 mg/m² and about 80 mg/m² of polyacrylamide.

6. A red-sensitive silver iodobromide (1.3% iodide; 1.5 micron) layer comprising about 1300 mg/m² of silver and about 780 mg/m² of gelatin.

7. An interlayer comprising about 3257 mg/m² of the pentapolymer described in layer 3, about 171 mg/m² of polyacrylamide, and about 126 mg/m² of dantoin.

8. A magenta dye developer layer comprising about 420 mg/m² of magenta dye developer, about 315 mg/m² of gelatin, about 500 mg/m² of 2-phenylbenzimidazole and 50 mg/m² of 2,3-bis[1-(4-hydroxyphenyl)-tetrazolyl-(5)mercapto]-2-propanone oxime.

9. A layer comprising about 538 mg/m² of Dow 620 carboxylated styrene-butadiene copolymer latex and about 180 mg/m² of gelatin.

10. A green-sensitive silver iodobromide emulsion layer comprising about 1177 mg/m² of silver (1.8 micron, 1% iodide), about 294 mg/m² of silver (1.1 about 260 mg/m² of MPHQ;

11. A layer comprising about 1966 mg/m² of the pentapolymer described in layer 3, about 104 mg/m² of polyacrylamide, about 564 mg/m² of the non-diffusible colorless thiazolidine silver ion scavenger

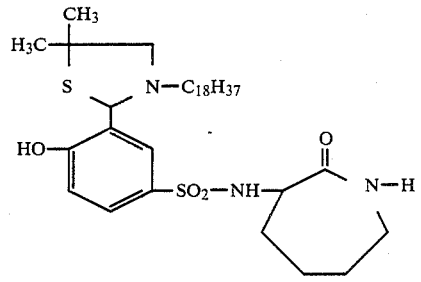

and about 21 mg/m² of succindialdehyde;

12. A layer comprising about 300 mg/m² of gelatin;

13. A yellow image dye-providing layer comprising about 1345 mg/m² of the yellow image dye-releasing thiazolidine used in Example 2 and about 538 mg/m² of gelatin;

14. A layer comprising about 538 mg/m² of 2-phenyl-5-tertiarybutyl-hydroquinone and about 538 mg/m² of gelatin;

15. A blue-sensitive silver iodobromide (6% iodide) layer comprising about 290 mg/m$^2$ of silver (1.6 micron), and about 538 mg/m$^2$ of gelatin; and 16. An antiabrasion layer comprising about 323 mg/m$^2$ of gelatin.

For comparison purposes, a bichrome (cyan and magenta) was prepared having the same composition as layers 1 through 12 of photosensitive element D, and a yellow monochrome was prepared having the same composition as layers 1–3 and 13–16.

An aqueous alkaline processing composition was prepared comprising:

| | |
|---|---|
| Water | 1566 g. |
| Titanium dioxide | 2312 g. |
| Poly(diacetone acrylamide)oxime | 32 g. |
| Potassium hydroxide (50% aqueous solution) | 490 g. |
| Colloidal silica (30% aqueous solution) | 37 g. |
| Zonyl FSN (40% solids) | 23.5 g. |
| N—phenethyl-α-picolinium bromide (50% solids) | 139 g. |
| 6-methyluracil | 28.1 g. |
| 2 methylimidazole | 23.4 g. |
| Hypoxanthine | 27.5 g. |
| 1-(4-hydroxyphenyl)-1H—tetrazole-5-thiol | 0.92 g. |
| Opacifying Dye 1 | 21 g. |
| Opacifying Dye 2 | 76.7 g. |

A second processing composition was prepared having the same composition except the quaternary N-phenethyl-α-picolinium bromide was omitted.

A photosensitive element of each of the above types was exposed and processed as in Example 1 using each of the above processing compositions and an image-receiving element similar to the one described in Example 2, the rollers being spaced apart 0.028 inch for the bichrome and three color photosensitive elements and 0.0024 inch for the monochrome. The result images showed the following red, green and blue reflection densities for the neutral columns:

| Element | Red | Green | Blue |
|---|---|---|---|
| | $D_{max}$ With Quaternary | | |
| D | 1.50 | 1.53 | 1.33 |
| Bichrome | 2.12 | 2.17 | 0.50 |
| Monochrome | 0.10 | 0.19 | 1.86 |
| | $D_{min}$ With Quaternary | | |
| D | 0.11 | 0.10 | 0.16 |
| Bichrome | 0.10 | 0.12 | 0.17 |
| Monochrome | 0.09 | 0.07 | 0.13 |
| | $D_{max}$ Without Quaternary | | |
| D | 1.83 | 1.69 | 1.93 |
| Bichrome | 1.73 | 1.93 | 0.47 |
| Monochrome | 0.10 | 0.21 | 1.99 |
| | $D_{min}$ Without Quaternary | | |
| D | 0.10 | 0.10 | 0.31 |
| Bichrome | 0.13 | 0.13 | 0.17 |
| Monochrome | 0.08 | 0.08 | 0.12 |

$D_{min}$ of the three color was substantially lower if the quaternary was present. In addition, the color separation was much better, and the magenta and cyan drop-off was much less. The reason why the presence of the quaternary is so beneficial in the three-color hybrid film when it is so relatively unimportant in getting good control of either the dye developer or dye releasing-thiazolidine systems independently is not completely understood.

In the above examples, the silver halide emulsion used with the image dye-releasing thiazolidine has been a silver iodobromide emulsion. The inclusion of iodide has been found to give improved minimum densities by being faster developing and slower dissolving, thereby minimizing the possibility that exposed silver halide will be dissolved before it can be developed, with consequent undesired thiazolidine cleavage and dye release. For the same reasons, it will be understood that the selection of the silver solvent and the colorless silver halide developing agent used with the image dye-releasing thiazolidine should be such that the initiation and rate of development is sufficiently faster than the rate of silver dissolution to obtain the desired image control.

In certain embodiments of this invention it may be desirable to incorporate a color correction filter dye in a layer of the sheet through which exposure is effected, as described in U.S. Pat. No. 4,329,411 issued May 11, 1982 to Edwin H. Land.

It is well known in the art that for in-camera processing the processing composition should include a viscosity-increasing polymer of the type which, when the composition is spread and dried, forms a relatively firm and stable film. High molecular weight polymers are preferred, and include cellulosic polymers such as sodium carboxymethyl cellulose, hydroxyethyl cellulose and hydroxyethyl carboxymethyl cellulose. Another class of useful viscosity-increasing polymers comprises the oxime polymers disclosed and claimed in U.S. Pat. No. 4,202,694 issued May 13, 1980 to Lloyd D. Taylor. Suitable oxime polymers include polydiacetone acrylamide oxime as well as copolymers, e.g., oximated polydiacetone acrylamide/acrylic acid, and oximated graft copolymers, e.g., grafts of diacetone acrylamide oxime onto hydroxyethyl cellulose. The preferred concentration of such oxime polymers is about 1% by weight or less, e.g., about 0.8% by weight as in the above example.

Although this invention has been described primarily by reference to integral film units, it will be understood that it may also be practiced in the well known peel-apart format.

It will be understood that the neutralizing layer 12 and timing layer 14 may be coated between the transparent support 50 and the image-receiving layer 54, as described in the above-mentioned U.S. Pat. No. 3,415,644. Other techniques for controlling the pH known in the art also may be used.

The positive component 5 and the negative component 1 shown in the FIGURE may be secured to each other along their marginal edges as described in U.S. Pat. No. 3,415,644. They may be temporarily laminated to each other by a bond of such a nature that these elements may be readily separated by the distribution of the processing composition following rupture of the pod, as disclosed, for example, in U.S. Pat. No. 3,793,023 issued Feb. 19, 1974 to Edwin H. Land and to which reference may be made.

Neutralizing layers such as the polymeric acid layer are well known in the art and are described in detail, for example, in the above-noted U.S. Pat. Nos. 3,415,644 and 3,647,437 to which patents reference may be made.

In the preferred embodiments, an anti-reflection coating is present on the outer surface of the image-receiving element, e.g., transparent support 50.

It will be understood that the various layers may include one or more surfactants or wetting agents, as desired to facilitate coating or dispersion preparation, as is well known in the photographic art.

The clearing coat or layer 54 is adapted to quickly decolorize the optical filter agent immediately adjacent the interface, thereby permitting earlier viewing of the emerging image. Suitable decolorizing layers are described, for example, in U.S. Pat. No. 4,298,674 issued Nov. 3, 1981 to Edwin H. Land, Leon D. Cerankowski and Neil C. Mattucci, U.S. Pat. No. 4,294,907 issued Oct. 13, 1981 to Irena Bronstein-Bonte, Edward P. Lindholm and Lloyd D. Taylor, and U.S. Pat. No. 4,367,277 issued Jan. 4, 1983 to Charles K. Chiklis and Neil C. Mattucci.

For convenience, the disclosures of the aforementioned U.S. Pat. Nos. 2,983,606, 3,415,644, 3,647,437, 3,719,489, 4,060,417 and 4,098,783 are expressly incorporated herein.

Since certain changes may be made in the above product and process without departing from the scope of the invention herein involved, the invention is not intended to be limited thereto but to include variations and modifications obvious to those skilled in the art and which are within the spirit of the invention and the scope of the appended claims.

What is claimed is:

1. A diffusion transfer film unit comprising a first sheet including a support and a second sheet including a support, said first and second sheets being in superposed relationship or adapted to be placed in superposed relationship with said supports outermost; said first support carrying a red-sensitive silver halide emulsion having associated therewith a cyan image dye-providing material, a green-sensitive silver halide emulsion layer having associated therewith a magenta image dye-providing material, and a blue-sensitive silver halide emulsion layer having associated therewith a yellow image dye-providing material; an image-receiving layer carried on one of said supports; the only image dye-providing material associated with the silver halide emulsion layer closest to said image-receiving layer is an image dye-releasing thiazolidine, the only image dye-providing material associated with the silver halide emulsion most distant from said image-receiving layer is a dye developer, and the image dye-providing material associated with the other of said silver halide emulsions is either a dye developer or an image dye-releasing thiazolidine; said film unit including means providing a light-reflecting layer against which an image in said image-receiving layer may be viewed; and means providing a processing composition containing a silver halide solvent for distribution between the superposed sheets.

2. A film unit as defined in claim 1 wherein said image-receiving layer is carried by said second support; said blue-sensitive silver halide emulsion layer is closest to said image-receiving layer; and said yellow image dye-providing material is a yellow image dye-releasing thiazolidine.

3. A film unit as defined in claim 2 wherein said second support is opaque; said means providing a light-reflecting layer is a layer of a light-reflecting pigment positioned between said opaque support and said image-receiving layer; and said second sheet is adapted to be separated from said first sheet after a transfer image is formed in said image-receiving layer.

4. A film unit as defined in claim 2 wherein said second support is transparent; said sheets are adapted to be held in superposed relationship after the image is formed in said image-receiving layer; and said means for providing said light-reflecting layer comprise a light-reflecting pigment dispersed in said processing composition.

5. A film unit as defined in claim 2 wherein said cyan image dye-providing material is a cyan dye developer, and said magenta image dye-providing material is a magenta dye developer.

6. A film unit as defined in claim 2 wherein said blue-sensitive silver halide emulsion layer has associated therewith a colorless silver halide developing agent which has an oxidation potential ($E_{\frac{1}{2}}$) more negative than said dye developers.

7. A film unit as defined in claim 6 wherein said colorless silver halide developing agent has an oxidation potential ($E_{\frac{1}{2}}$) at least as negative as $-300$ mv.

8. A film unit as defined in claim 6 wherein said processing composition includes a quaternary ammonium compound.

9. A film unit as defined in claim 1 wherein a non-diffusible silver ion scavenger is provided between (a) said silver halide emulsion positioned closest to said image-receiving layer and its associated image dye-releasing thiazolidine and (b) the next adjacent silver halide emulsion.

* * * * *